US009975149B2

(12) United States Patent
Lampe

(10) Patent No.: US 9,975,149 B2
(45) Date of Patent: May 22, 2018

(54) DEVICE AND METHOD FOR SORTING BULK MATERIAL

(71) Applicant: SIKORA AG, Bremen (DE)

(72) Inventor: Siegmar Lampe, Suhrfled (DE)

(73) Assignee: SIKORA AG, Bremen (DE)

( * ) Notice: Subject to any disclaimer, the term of this patent is extended or adjusted under 35 U.S.C. 154(b) by 0 days. days.

(21) Appl. No.: 15/028,635

(22) PCT Filed: Apr. 22, 2014

(86) PCT No.: PCT/EP2014/058148
§ 371 (c)(1),
(2) Date: Apr. 11, 2016

(87) PCT Pub. No.: WO2015/051927
PCT Pub. Date: Apr. 16, 2015

(65) Prior Publication Data

US 2016/0250665 A1 Sep. 1, 2016

(30) Foreign Application Priority Data

Oct. 11, 2013 (EP) ..... 13188370

(51) Int. Cl.
*B07C 5/34* (2006.01)
*B07C 5/342* (2006.01)
(Continued)

(52) U.S. Cl.
CPC ..... *B07C 5/3427* (2013.01); *B07C 5/02* (2013.01); *B07C 5/34* (2013.01); *B07C 5/342* (2013.01);
(Continued)

(58) Field of Classification Search
CPC ..... B07C 5/02; B07C 5/3416; B07C 5/342; B07C 5/3422; B07C 5/3425;
(Continued)

(56) References Cited

U.S. PATENT DOCUMENTS 4,373,638 A * 2/1983 Schapper ..... B07B 13/16 209/570
5,148,923 A * 9/1992 Fraenkel ..... B07C 5/02 198/445
(Continued)

FOREIGN PATENT DOCUMENTS

DE 102010024784 12/2011
EP 1045734 10/2000
(Continued)

OTHER PUBLICATIONS

Translation of International Preliminary Report on Patentability for PCT/EP2014/058148; dated Apr. 21, 2016; 10 pages.
(Continued)

*Primary Examiner* — Joseph C Rodriguez
(74) *Attorney, Agent, or Firm* — Barclay Damon LLP

(57) ABSTRACT

The invention relates to a device and corresponding method for sorting bulk material, in particular pellets, comprising a vibration conveyor apparatus and a feed apparatus, which feeds bulk material to the vibration conveyor apparatus and is examined for defects using a detector apparatus. Bulk material identified as being non-defective is deposited in a first outlet and bulk material identified as being defective is shorted out and deposited in.

16 Claims, 2 Drawing Sheets

(51) Int. Cl.
*B07C 5/02* (2006.01)
*B07C 5/346* (2006.01)
*B07C 5/36* (2006.01)

(52) U.S. Cl.
CPC ..... *B07C 5/346* (2013.01); *B07C 5/3416* (2013.01); *B07C 5/36* (2013.01); *B07C 5/363* (2013.01); *B07C 5/366* (2013.01); *B07C 2501/0018* (2013.01)

(58) Field of Classification Search
CPC ..... B07C 5/3427; B07C 5/36; B07C 5/363; B07C 5/366; B07C 2501/0018
USPC ..... 209/638, 639, 641
See application file for complete search history.

(56) References Cited

U.S. PATENT DOCUMENTS 5,236,092 A * 8/1993 Krotkov ..... B07C 5/02 198/609
5,246,118 A 9/1993 Mosher
5,352,888 A * 10/1994 Childress ..... B07C 5/366 209/586
5,713,473 A * 2/1998 Satake ..... B07C 5/3416 15/309.2
5,779,058 A * 7/1998 Satake ..... B07C 5/3425 209/581
5,865,990 A * 2/1999 Novak ..... B07C 5/3425 209/579
6,265,683 B1 * 7/2001 Flottmann ..... B07C 5/10 209/576
6,266,390 B1 * 7/2001 Sommer, Jr. ..... B07C 5/3427 378/45
6,313,423 B1 * 11/2001 Sommer ..... B07C 5/342 209/577
6,639,167 B1 * 10/2003 Bjork ..... B07C 5/12 198/751
6,734,383 B1 * 5/2004 Calcoen ..... B07C 5/3427 209/577
6,864,970 B1 * 3/2005 Ruymen ..... B07C 5/342 356/237.1
6,884,956 B2 * 4/2005 Murata ..... B07C 5/3425 209/576
7,328,808 B2 * 2/2008 Kokko ..... B07B 11/06 209/639
7,763,820 B1 * 7/2010 Sommer, Jr. ..... B07C 5/346 209/576
8,144,831 B2 * 3/2012 Sommer, Jr. ..... G01N 23/06 378/53
8,610,019 B2 * 12/2013 Roos ..... B07C 5/346 209/576
8,847,094 B2 * 9/2014 Tavakkoli ..... B07C 5/3425 209/589
9,296,019 B2 * 3/2016 Berghmans ..... B07C 5/342
9,458,524 B2 * 10/2016 Bakke ..... C22B 26/10
9,561,528 B2 * 2/2017 Kazakov ..... B07C 5/346
2003/0094403 A1 5/2003 Murata et al.
2013/0056398 A1 * 3/2013 Adams ..... B07C 5/342 209/587

FOREIGN PATENT DOCUMENTS

GB 2067753 7/1981
NL 1030298 5/2007
WO WO2008068144 6/2008
WO WO2012094568 7/2012

OTHER PUBLICATIONS

International Search Report & Written Opinion for PCT/EP2014/058148; dated: Apr. 11, 2014; 10 pages.

* cited by examiner

DEVICE AND METHOD FOR SORTING BULK MATERIAL

CROSS REFERENCE TO RELATED APPLICATION

This application is a national stage application under 35 U.S.C. § 371 of International Application No. PCT/EP2014/058148, filed Apr. 22, 2014, which claims priority of European Patent Application No. 13188370.4, filed Oct. 11, 2013, the entire contents of each application being herein incorporated by reference.

BACKGROUND OF THE INVENTION

The invention relates to a device for sorting bulk material, in particular pellets, comprising a vibration conveyor apparatus and a feed apparatus, which feeds bulk material to the vibration conveyor apparatus, further comprising a first outlet and a second outlet, wherein the first outlet is arranged such that the bulk material conveyed over an end of the vibration conveyor apparatus falls into the first outlet, further comprising at least one detector apparatus, which is designed to examine the bulk material conveyed by the vibration conveyor apparatus for defects and a sorting apparatus, which is designed to manipulate bulk material identified as defective by the detector apparatus and conveyed over the end of the vibration conveyor apparatus in its trajectory such that the bulk material identified as defective falls into the second outlet.

Moreover, the invention relates to a method for sorting bulk material, in particular pellets, in which bulk material is fed to a vibration conveyor apparatus, wherein the bulk material is conveyed over one end of the vibration conveyor apparatus and falls into a first outlet, in which furthermore the bulk material conveyed by the vibration conveyor apparatus is examined for defects and bulk material identified as defective and conveyed over the end of the vibration conveyor apparatus is manipulated in its trajectory such that the bulk material identified as defective falls into a second outlet.

The detecting and sorting out of defective bulk material is very important. One example is plastic pellets, which serve as the raw material for an extrusion process, in which a plastic insulation is applied to a metallic conductor. Contaminants in these pellets can impact the insulating function and should thus be detected and the defective pellets should be sorted out.

It is known to process a portion of a batch of plastic pellets into a thin plastic film and to examine this plastic film for contaminants. If no contaminants are detected, the entire batch is released. Naturally, only a small part of the pellets is thereby examined so that contaminants cannot be reliably excluded.

A device and a method for sorting pellets are known from EP 1 045 734 B1, in which a 100% check takes place. The pellets are examined for contaminants by means of an optical detector apparatus while they are still located on the transport apparatus. If the pellets are not subsequently further manipulated, they fall over the end of the transport apparatus into a first container. However, if defects are detected by the optical detector apparatus, a blowout apparatus is activated, which diverts falling pellets over the end of the transport apparatus out of its trajectory so that they fall into a second container. The angle of the transport apparatus with respect to the horizontal should in that case be selected such that the variation of the pellet trajectories is as low as possible and as few good (non-defective) pellets as possible fall into the second container. A multi-sensory arrangement for the optical inspection and sorting of bulk material is also known from DE 10 2010 024 784 A1. For sorting a diamond-containing material, it is known from GB 2 067 753 A to convey it as much as possible in one layer on a rotating drum provided with suction holes by means of a vibration conveyor, excite it to fluorescence through an X-ray source and detect the fluorescence with a photomultiplier. It is also known from U.S. Pat. No. 5,246,118 A to detect by means of an optical sensor bulk material after it leaves a vibration conveyor in free fall and to sort it out, if applicable. Moreover, a chute is known from EP 1 726 372 A1, via which a granular material is conveyed. After leaving the chute, when the material moves in the vertical direction, it is detected by means of an optical sensor.

On one hand, the disadvantage of the prior art is that only contaminants on the pellet surface can be detected by means of the known detector apparatuses since the pellets are not generally transparent. The defect detection is thereby restricted. Moreover, a not insignificant variation in the trajectories of the pellets results in particular in the case of the arrangement of the transport apparatus described in EP 1 045 734 B1. Among other things, this makes an examination of the pellets more difficult while they are in free fall.

BRIEF SUMMARY OF THE INVENTION

Starting from the explained prior art, the object of the invention is to provide a device and a method with which a comprehensive 100% check of bulk material is achieved in a reliable manner.

For a device, the invention solves the object according to the first aspect in that a rotationally driven roller connects to the end of the vibration conveyor apparatus, on which the bulk material conveyed over the end of the vibration conveyor apparatus ends up and which conveys the bulk material with a trajectory predetermined by the rotation of the roller in the direction of the first outlet.

According to a second aspect, the invention solves the object for a device in that a bent section connects to the end of the vibration conveyor apparatus, on which the bulk material conveyed over the end of the vibration conveyor apparatus ends up and which conveys the bulk material with a trajectory predetermined by its bend in the direction of the first outlet.

For a method, the invention solves the object according to a first aspect in that the bulk material conveyed over the end of the vibration conveyor apparatus is conveyed onto a rotationally driven roller connecting to the end of the vibration conveyor apparatus and the bulk material is conveyed with a trajectory predetermined by the rotation of the roller in the direction of the first outlet.

According to a second aspect, the invention solves the object for a method in that bulk material conveyed over the end of the vibration conveyor apparatus is conveyed onto a bent section connecting to the end of the vibration conveyor apparatus and the bulk material is conveyed with a trajectory predetermined by the bent of the bent section in the direction of the first outlet.

The device according to the invention and the method according to the invention are each suitable for the inspection of almost any bulk material, such as e.g. granulates and other granular products, grains, tablets, flakes, food chips, food or plastic flakes and the like. In particular, the invention is suited for the inspection of plastic pellets. As initially explained, plastic pellets are used as the raw material for extrusion processes, in which a plastic insulation is extruded onto a metallic conductor. Such pellets often have a white color. For such bulk material, a 100% inspection for potential contaminants is of decisive importance. In particular, the detection of metallic contaminations, which can impair the insulating function, is very important.

It should also be ensured that the bulk material is not contaminated in the sorting process itself. This problem occurs in particular in the conveyor belts used in the prior art, which can fray and can thus lead to additional contaminations in the bulk material. Based on this background, the use of a vibration conveyor apparatus is especially advantageous since no components detach even after longer operation, which could lead to a contamination of the inspected bulk material. In this connection, it is particularly advantageous if the vibration conveyor apparatus is made of metal. The risk of contaminations through abrasion or wear is minimized. The device according to the invention is thus also constructively designed so that it does not contribute to the contamination of the bulk material itself.

The bulk material is fed to the vibration conveyor apparatus by means of a feed apparatus, e.g. a feed hopper or reservoir. Vibration conveyor apparatuses are generally known and reliably convey bulk material along a conveying direction. At least one detector apparatus examines the bulk material conveyed via the vibration conveyor apparatus while it is still located on the vibration conveyor apparatus and/or after it has already left the vibration conveyor apparatus. A first outlet and a second outlet are arranged downstream of the vibration conveyor apparatus in the conveying direction of the bulk material. If the bulk material continues to remain unmanipulated by the further provided sorting apparatus, it automatically falls into the first outlet after exiting the vibration conveyor apparatus. In contrast, if the sorting apparatus is activated, the trajectory of the bulk material will thus be manipulated so that it falls into the second outlet. The first outlet accordingly forms a good outlet for the quality requirements of corresponding good bulk material, and the second outlet forms a bad outlet for the quality requirements of non-corresponding bad bulk material. The sorting apparatus can be arranged downstream of the vibration conveyor apparatus so that it manipulates the bulk material in its track when it is already in free fall. The first outlet can comprise a first container and the second outlet can comprise a second container. The bulk material is then conveyed into the respective container. But it is also possible that one or both outlets lead directly to a further processing of the bulk material, for example within the framework of a continuous process.

According to the invention, a rotationally driven roller or a bent section connects directly to the end of the vibration conveyor apparatus. The bulk material can thus be conveyed directly from the vibration conveyor apparatus onto the roller or the bent section. The roller rotates in particular around a rotational axis progressing perpendicular to the conveying direction of the bulk material. The bulk material then experiences no lateral directional change by the roller. Preferably, neither does the bulk material experience a lateral directional change by the bent section. The roller is designed in particular cylindrically and transfers the separated and compacted bulk material conveyed by the vibration conveyor apparatus in a defined and uniform trajectory. The trajectory transferred to the bulk material by the roller is independent of any angle of one or more vibration conveyors of the vibration conveyor apparatus with respect to the horizontal. Rather, the trajectory of the bulk material is specified exclusively by the dimensions and the rotational speed of the roller. The centripetal and centrifugal forces are significant. Through the effect of these forces, the bulk material is brought to its specified trajectory in a very controlled manner. The variation of the trajectories of the bulk material is considerably lower than in the prior art. A very constant velocity is also applied to the bulk materials by the rotationally driven roller provided according to the invention. This more clearly defined trajectory according to the invention and speed of the bulk material improves the defect detection. A constant speed of the bulk material through the measurement plane is thus of decisive importance for a particularly high resolution and thus measurement accuracy with respect to the size of contaminants. Even a low variation in the distance of the bulk material to the respective sensor apparatuses is essential in order to always capture it optimally focused with the highest resolution. As explained, both conditions for a highly accurate measurement are optimally met by the provision of the rotationally driven roller according to the invention. In the case of the invention according to the second aspect, the trajectory of the bulk material is specified by a bent section connecting to the end of the vibration conveyor apparatus. The bent section can be designed for example like a parabola or a circle. It can also concern a non-rotating roller. The bent section can be designed in a vibrating or fixed manner. The bent section forms a ramp supporting the trajectory of the bulk material subsequent to the vibration conveyor apparatus, in particular subsequent to a last vibration conveyor of the vibration conveyor apparatus. The dimension of this ramp can be similar to the dimension of the rotationally driven roller. In contrast to the prior art, by providing an X-ray detector apparatus and an optical detector apparatus working in the visible or IR wavelength range, all defects in the bulk material can be reliably detected, beside surfaces defects also in particular defects lying inside the bulk material particles.

Naturally, a control and regulation apparatus is also provided according to the invention, which controls or respectively regulates the entire sorting process. An evaluation apparatus, which also correspondingly activates the sorting apparatus, is provided for evaluating the measurement results of the at least one detector apparatus. The evaluation apparatus can be integrated into the control and regulation apparatus.

According to one design, the at least one vibration conveyor apparatus can comprise several vibration conveyors arranged in succession in the conveying direction of the bulk material. Furthermore, it can be provided that at least two of the several vibration conveyors, preferably all of the several vibration conveyors, are arranged at different angles with respect to the horizontal and/or that at least two of the several vibration conveyors, preferably all of the several vibration conveyors, have a vibration drive individually controllable with respect to amplitude and/or frequency. All vibration conveyors can be driven in a vibrating manner. For controlling the movement of the bulk material, it is particularly advantageous if the vibration conveyors can be set independently of each other with respect to their vibration frequency and their vibration amplitude.

For example, three vibration conveyors can be provided, via which the bulk material is transported into the first or respectively second outlet starting from the feed apparatus. The first vibration conveyor can then convey the bulk material, the second vibration conveyor can separate the bulk material and the third vibration conveyor can compact the bulk material. The bulk material can be fed by the feed apparatus first to a first vibration conveyor. It serves to supply energy to the bulk material so that it begins to move in the conveying direction. A subsequent second vibration conveyor serves to accelerate and separate the bulk material. For this, for example, the second vibration conveyor can be tilted more than the first vibration conveyor with respect to the horizontal. For example, a third vibration conveyor can connect to the second vibration conveyor, which again has less tilt with respect to the horizontal. It serves to compact the bulk material and lends itself in particular for detecting defects in the bulk material. It is generally also possible that one or more of the vibration conveyors are not tilted with respect to the horizontal. However, it is advantageous for conveying the bulk material if all vibration conveyors have at least a slight tilt with respect to the horizontal.

According to a further design, at least one vibration conveyor of the vibration conveyor apparatus, for example the first and/or the second and/or the third vibration conveyor, can have a wall progressing transversely to the conveying direction of the bulk material, which is designed to hold back the bulk material in the case of a stopping of the vibration of this vibration conveyor. As soon as the vibration conveyor equipped with the wall no longer vibrates, the wall stops the further flow of the bulk material. In a simple manner, no mechanical closing apparatus is thereby required in the area of the feed apparatus. Moreover, the wall ensures that the bulk material escaping for example from a round opening of a feed apparatus is distributed as evenly as possible on the vibration conveyor.

However, even after passing such a wall, the components of the bulk material, for example the pellets, often lie on top of each other in several layers, which is undesirable for the further process. It can thus be further provided that at least one vibration conveyor of the vibration conveyor apparatus, in particular one or more of the vibration conveyors, has at least one, in particular a plurality, of barrier(s) progressing transversely to the conveying direction of the bulk material, preferably forming a wave profile or a triangular profile in cross-section. The preferably wavelike or triangular barriers serve for one to homogenize the speed of the components of the bulk material, in that they are repeatedly accelerated and decelerated. The barriers also serve to supply a vertical energy to the components of the bulk material in particular on the second vibration conveyor in the conveying direction. This serves to break down the multiple layers of the components of the bulk material so that the bulk material is subsequently located in a single-layer "jam arrangement." It is the goal of this "jam arrangement" that the components of the bulk material can no longer move sideways, i.e. similar to how cars cannot change lanes in a traffic jam. A defined position of the components of the bulk material is thereby present for a subsequent inspection in a detector apparatus, which also no longer changes on the further path up to the sorting apparatus.

According to a further design, a rotary drive of the roller can be actuatable such that the roller is driven with such a rotational speed that the bulk material conveyed over the end of the vibration conveyor apparatus is accelerated or decelerated in its conveying speed by the roller. The roller thus turns faster or slower than the speed supplied to the bulk material by the (last) vibration conveyor. The bulk material is accelerated or respectively decelerated when it makes its way from the (last) vibration conveyor to the surface of the roller. The trajectory of the bulk material can thereby be manipulated in the desired manner after leaving the roller.

According to a further design, it can be provided that the detector apparatus comprises at least one optical detector apparatus working in the wavelength range visible (to the human eye) and/or at least one optical detector apparatus working in the infrared wavelength range with at least one optical radiation source and at least one optical sensor and/or that the detector apparatus comprises at least one X-ray detector apparatus with at least one X-ray radiation source and at least one X-ray sensor. The X-ray detector apparatus shines through the bulk material to be examined. At least one optical detector apparatus can also be designed such that it does not shine through the bulk material; the bulk material is thus non-transparent for the used wavelength range. The combination of at least one such optical detector apparatus with an X-ray detector apparatus is particularly advantageous since both processes together compensate for the disadvantages of the respective other process. For example, such an optical detector apparatus can differentiate a blue pellet from a red pellet, which an X-ray detector apparatus cannot generally do, since the color additives effectuate no significant differential attenuation. However, the X-ray detector can detect contaminations within pellets, which the optical detector apparatus cannot do in this case. But it is also possible to provide one or several optical detector apparatuses shining through the bulk material, which work for example in the infrared wavelength range, in addition to or alternatively to an X-ray detector apparatus shining through the bulk material. It is also possible in the case of a correspondingly transparent bulk material to provide an optical detector apparatus shining through the bulk material, which works in the visible wavelength range. Naturally, other detector apparatuses are also alternatively or additionally conceivable, for example inductive sensors or the like. All named detector apparatuses are combinable with each other in any manner.

According to a further design, it can be provided that an optical sensor of the at least one optical detector apparatus comprises a high-speed sensor, in particular a high-speed sensor operated in TDI mode (Time Delay Integration Mode) and/or that at least one X-ray sensor of the at least one X-ray detector apparatus comprises a high-speed sensor, in particular a high-speed sensor operated in TDI mode (Time Delay Integration Mode). The used high-speed sensors can be in particular high-speed cameras, e.g. line scan cameras. Of course, the type of the respectively used image processing depends on the geometry of the material to be examined. The image processing takes place in particular in real time, for example on a FPGA board (Field Programmable Gate Array).

The advantage of the operation of the optical or respectively X-ray sensors in TDI mode lies in the low required illumination and the high resolution. Comparable systems of the prior art work with an optical resolution of 100 μm, while optical resolutions in the range of 30 μm can be achieved with this design of the invention. Specifically in the case of the operation of the sensor in TDI mode, a particularly high evenness of the trajectory and speed of the bulk material is important due to the temporal integration. This is guaranteed by the roller according to the invention. In the case of the optical detector apparatus, the illumination of the bulk material does not preferably take place with direct light, since this could lead to bothersome reflections on the bulk material surface, which could in turn conceal contaminations. The bulk material is instead irradiated with diffuse light. This can be realized for example through use of a so-called light dome.

It can further be provided that the detector apparatus comprises two optical detector apparatuses, wherein a first optical detector apparatus examines the bulk material from a top side on the rotationally driven roller or respectively on the bent section or after leaving the rotationally driven roller or respectively the bent section, and wherein a second optical detector apparatus examines the bulk material from a bottom side, when the bulk material is in free fall after leaving the rotationally driven roller or respectively the bent section. A particularly comprehensive optical inspection of the bulk material can take place through use of two optical detector apparatuses. The measurement from the top side of the bulk material can in that case take place in particular directly after leaving the roller or respectively the bent section.

According to a further design, it can be provided that at least one optical detector apparatus examines the bulk material in front of a non-illuminated dark background, preferably a non-illuminated black background, wherein the plane of focus of the at least one optical sensor lies in the range of the bulk material to be examined. In the prior art, an optical detection of for example dark contaminants generally takes place in front of a background that is as white as possible with the idea of achieving the greatest possible contrast of the contaminants in front of the background. Indeed, a bright or respectively white background results in an unavoidable casting of a shadow by the bulk material and possible falsification of the measurement result. This is prevented by the dark or respectively black design of the background. The background is thereby not illuminated, i.e. passive. A non-illuminated background means that it is not illuminated with a separate light source or illuminates itself. Naturally, the background can be illuminated slightly through unavoidable incidence of ambient light or respectively through scattering of the optical radiation emitted by the optical radiation source(s). The optical sensor and the optical radiation source face the background. Moreover, the background is out of focus. The focal plane of the optical sensor(s) lies in a plane in which the bulk material is located. There is thus a defined background on which the casting of a shadow falsifying the measurement result does not result due to the dark or respectively black design. The dark or respectively black background can simultaneously be removed by a suitable standardization within the framework of the assessment of the measurement results so that any optical defects such as dark or black surface contaminants stand out in a contrast-rich manner and are securely detected despite the dark or respectively black color of the background. In particular, the optical radiation is reflected on a possible surface contamination, which can then be reliably identified within the course of the assessment.

It can also be provided that a window transparent for X-ray radiation is designed in the floor of a vibration conveyor of the vibration conveyor apparatus, wherein the at least one X-ray radiation source shines through the bulk material conveyed over the vibration conveyor and the window and the at least one X-ray sensor detects the X-ray radiation shining through the bulk material and the window. Due to the material and the small dimensions of some bulk material, for example plastic pellets, very soft X-ray radiation must be used for the X-ray detection. It is thereby not possible to shine through the material of the vibration conveyor, usually metal. According to this design, a window transparent for X-ray radiation is thus installed for example in the last vibration conveyor in front of the roller or respectively the bent section. This can be a so-called Mylar window. Mylar is made of polyethylene, is very thin and yet very stable and tear-resistant. The X-ray radiation source can be arranged above or below the vibration conveyor. The X-ray sensor is then arranged accordingly below or respectively above the vibration conveyor. The window can vibrate with the vibration conveyor or can be decoupled from the vibration of the vibration conveyor and can thus be rigid. The latter is preferred for the measurement accuracy.

It can also be provided that the rotationally driven roller or respectively the bent section is made at least in sections of a material transparent for X-ray radiation and that the at least one X-ray sensor is arranged in a torque-proof manner in the rotating roller or respectively below or above the top side of the bent section, wherein the at least one X-ray radiation source shines through the bulk material conveyed over the rotationally driven roller or respectively the bent section and the X-ray radiation shining through the bulk material is detected by the at least one X-ray sensor arranged in the rotationally driven roller or respectively below or above the top side of the bent section. After being received on the surface of the rotating roller or respectively the bent section and before being removed from the roller or respectively the bent section, the bulk material is fixed in its position. This is thus a generally suitable moment to subject the bulk material to detection, in particular X-ray detection. The aforementioned design is based on this idea. Moreover, the rotational speed of the roller is known, as well as a change in the rotational speed potentially occurring in the course of operation. The X-ray evaluation, in particular a TDI scan, can then be synchronized in a simple manner with the speed of the bulk material on the surface of the roller. Naturally, the X-ray sensor could also be arranged above or below the roller or be located on the lower end or in an inactive section of the vibration conveyor. The same applies in the case of the bent section. An arrangement between the vibration conveyor apparatus and the roller would also be conceivable. Furthermore, in the case of an arrangement of the X-ray sensor in the roller or respectively below or above the top side of the bent section, the entire roller or respectively the entire bent section can naturally also be made of a material transparent for X-ray radiation. The use of the same material as in the window explained above is conceivable.

According to a further design, it can be provided that the sorting apparatus comprises a blowout or suction apparatus, which diverts bulk material identified as defective from its trajectory through blowing or suctioning such that it falls into the second outlet. The blowout or suction apparatus can comprise a plurality of blowout or suction nozzles arranged along a row or along a two-dimensional array. As soon as a contamination is detected by one of the detector apparatuses, the sorting apparatus located downstream of the detector apparatuses is activated. When a plurality of blowout or suction nozzles is provided, the bulk material identified as defective, for example a pellet identified as defective, can be specifically diverted out of its trajectory so that it falls into the second outlet. The sorting apparatus can generally already be activated shortly before the passing of the bulk material identified as defective and can be deactivated again shortly after the passing. For safety reasons, not only the bulk material identified as defective is sorted out, but also a small amount of good bulk material.

Alternatively, it is also possible that the sorting apparatus comprises at least one mechanical ejector, which diverts bulk material identified as defective from its trajectory such that it falls into the second outlet. According to a further design, it is also possible that an apparatus for electrostatically charging the rotationally driven roller or respectively the bent section is provided so that the bulk material can be held electrostatically on the rotationally driven roller or respectively the bent section and can be ejected in a defined position by the rotationally driven roller or respectively the bent section. Furthermore, it is possible that the surface of the rotationally driven roller or respectively the bent section has a plurality of suction openings through which the bulk material is held in position on the rotationally driven roller or respectively the bent section and can be ejected in a defined position by the rotationally driven roller or respectively the bent section. In this design, the negative pressure apparatus, which generates a suitable negative pressure at the suction openings, is connected to the roller or respectively the bent section. The apparatus for electrostatically charging the rotationally driven roller or the bent section or respectively the suction openings together with the negative pressure apparatus can be part of the sorting apparatus.

According to a further design, bulk material diverted out of its trajectory by the sorting apparatus can end up in a sorting channel, which is subdivided into at least two channel sectors by at least one blade preferably arranged vertically. For example, in the case of the use of a blowout or suction apparatus, this blade prevents turbulence in the area of the sorting apparatus, which can ultimately lead to faulty sorting of the bulk material.

Generally, at least the vibration conveyor apparatus can be surrounded by a closed housing, in particular an air-tight housing. The air tightness is thereby sufficient in order to avoid a damaging entry of contaminants. Through a shielding of the bulk material from the ambient air, contamination of the bulk material by for example dust from the ambient air is avoided. It is thereby possible that excess pressure vis-à-vis the surroundings prevails within the housing. The entry of contaminants is thereby avoided particularly effectively. Naturally, it is generally also possible that negative pressure vis-à-vis the surroundings prevails in the housing. With the device according to the invention or respectively the method according to the invention, very small contaminations from a size of 50 μm can also already be detected. This would lead to undesired defect detections in the event of the occurrence of dust from the ambient air. In order to further secure the device, in particular the feed apparatus, the rotationally driven roller or respectively the bent section as well as the first and the second outlet can also be surrounded by the housing, in particular in an air-tight manner. Thus, the entire conveying path of the bulk material from the feed apparatus or respectively a potentially provided reservoir up to into the first or respectively second outlet is shielded from the ambient air. The device thus forms a closed system.

A guide cover adapted to the surface shape of the rotating roller or the bent section, in particular a guide plate, can be arranged at least in sections above the rotating roller or the bent section, wherein a separation distance, in which the bulk material is guided, is formed between the guide cover and the surface of the rotating roller or the bent section. The guide cover can have in particular a bend adapted to the bend of the surface of the roller or respectively of the bent section. Through the guidance of the guide cover, the variation of the conveyor belts of the bulk material particles is minimized. The detectability of defects is thereby further improved.

According to a further design, a guide channel tapering in cross-section in sections, through which the bulk material falls from the rotating roller or the bent section in the direction of the sorting apparatus, can be formed between the rotating roller or the bent section and the sorting apparatus. The guide channel is in particular a slit-like guide channel tapering at least in sections in the fall direction of the bulk material. The guide channel can taper in cross-section in the fall direction of the bulk material in a first channel section and expand again in a second channel section connecting to the first channel section. For this, the guide channel can have a first, mainly vertical, level wall and a second wall lying opposite the first wall and tapering at least in sections in the direction of the first wall. The second wall can be for example triangular or crescent-shaped in cross-section. A narrow, slit-like guide channel has the advantage that the bulk material, guided through the walls of the guide channel, arrives at the sorting apparatus with minimal variation of the trajectories. It has been shown that when the walls of the guide channel are arranged parallel, in particular when they are spaced only slightly, a negative pressure occurs when for example blowout nozzles are arranged or active right after this, wherein the negative pressure cannot suction the bulk material into the sorting apparatus but rather opposite its fall direction upwards into the channel. This can lead to impermissible faulty sorting of the bulk material. This applies in particular when the device is designed as a closed system, as explained above. This negative pressure is safely avoided through the section-wise cross-sectional narrowing of the guide channel and, if applicable, the subsequent cross-sectional expansion.

The device according to the invention is suitable in particular for carrying out the method according to the invention. Accordingly, the method according to the invention can be carried out with the apparatus according to the invention described or respectively claimed in this patent application.

BRIEF DESCRIPTION OF THE DRAWINGS

Exemplary embodiments of the invention are explained in greater detail below based on figures. They show schematically.

DETAILED DESCRIPTION OF THE INVENTION

Figure 1:
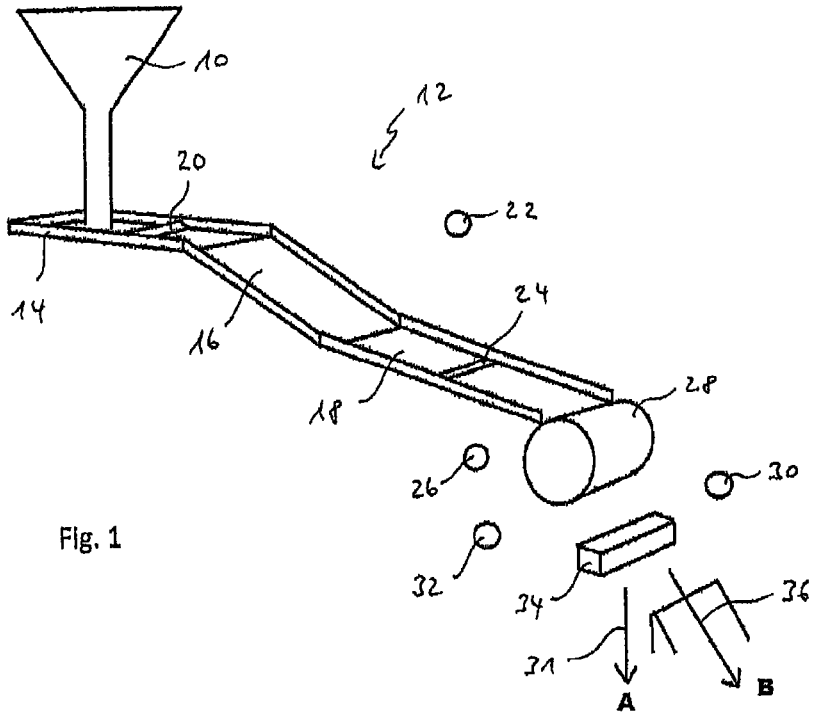
FIG. 1 is a perspective view of a device according to the invention for sorting bulk material and FIG. 2 is a part of the device from FIG. 1 in an enlarged perspective view.

If not otherwise specified, the same reference numbers indicate the same objects in the figures. Reference number 10 in FIG. 1 shows a feed apparatus with a feed hopper for bulk material, plastic pellets in the shown example. Although the device according to the invention and the method according to the invention are explained below based on the sorting of plastic pellets, the sorting of any other bulk material is naturally also possible. Moreover, the device comprises a vibration conveyor apparatus 12 with a first vibration conveyor 14, a second vibration conveyor 16 connected to the first vibration conveyor 14 and a third vibration conveyor 18 connecting to the second vibration conveyor 16. The feed apparatus 10 feeds the plastic pellets to the first vibration conveyor 14. All vibration conveyors 14, 16, 18 can be driven in a vibrating manner, wherein the vibration conveyors 14, 16, 18 are individually controllable with respect to their vibration sequence and vibration amplitude. For this, a control and regulation apparatus not shown in the figure is provided, which controls overall the device according to the invention. FIG. 1 further shows that the three vibration conveyors 14, 16, 18 are arranged at different angles with respect to the horizontal. The first vibration conveyor 14 has a slight tilt with respect to the horizontal, the third conveyor 18 also has a slight tilt with respect to the horizontal and the second vibration conveyor 16 has the greatest tilt with respect to the horizontal. The vibration conveyors 14, 16, 18 are designed in a ramp-like manner, wherein the movement of the plastic pellets is restricted laterally by side walls of the vibrations conveyors 14, 16, 18.

A wall 20 progressing transversely to the conveying direction of the bulk material is designed on the surface of the first vibration conveyor 14. It serves on one hand to distribute the plastic pellets leaving the opening of the feed hopper 10 onto the first vibration conveyor 14 evenly onto the vibration conveyor 14. Moreover, the wall 20 hold the pellets back from further movement as soon as the vibration conveyor 14 is stopped, i.e. no longer vibrates. On the first vibration conveyor 14, the movement of the pellets begins in the conveying direction. On the second vibration conveyor 16, increased kinetic energy is supplied to the pellets so that they are accelerated and separated in the conveying direction. On the surface of at least one vibration conveyor, for example of the second and/or third vibration conveyor 16, 18, one or a plurality of barriers (e.g., 42 on FIG. 2) progressing transversely to the conveying direction of the bulk material and preferably forming a wave profile or a triangular profile in cross-section is preferably formed. For one, these serve to homogenize the conveying speed of the pellets. They also give the pellets a vertical energy, which leads to the breakdown of the multiple layers of the pellets. Thus, after passing through the barrier(s), preferably of the wave profile or triangular profile of the barrier(s), the pellets are located in a single-layer "jam arrangement." In this arrangement, they can be examined by an X-ray detector apparatus, of which an X-ray radiation source is shown with reference number 22 in FIG. 1. A window 24 transparent for X-ray radiation, here a Mylar window 24, is designed in the floor of the third vibration conveyor 18. The X-ray radiation source 22 emits X-ray radiation, which shines through (penetrates) the pellets conveyed over the window 24 and the window 24. An X-ray sensor shown schematically with reference number 26, which detects the X-ray radiation, is located below the window 24. In this case, it is an X-ray camera operating in TDI mode. The X-ray detector apparatus examines the pellets for contaminants in its interior. The measurement results are fed to an evaluation apparatus integrated into the control and regulation apparatus, which decides on this basis whether the examined pellets should be sorted out as defective. In the shown example, a cylindrical roller 28 rotationally driven around the cylinder axis progressing perpendicularly to the conveying direction of the pellets connects directly to the end of the third vibration conveyor 18. The pellets make their way from the third vibration conveyor 18 onto the rotating roller 28, are transported a short distance by it and are subsequently transferred with a defined speed in a defined trajectory. As long as they are not thereby manipulated, they fall into a first outlet for good pellets along the trajectory 31 indicated with A in FIG. 1. In the shown example, the roller 28 is turned slightly faster than the conveying speed of the pellets before hitting the roller 28 so that the pellets are accelerated slightly.

FIG. 1 also shows with reference number 30 a first optical detector apparatus, which examines the pellets right after leaving the driven roller 28 from the top side. Reference number 32 shows a second optical detector apparatus, which examines the pellets in their trajectory from the bottom side after leaving the roller 28. Both optical detector apparatuses 30, 32 irradiate the pellets with diffuse light in front of a black background and have high-speed cameras as optical sensors, which are operated in TDI mode. The optical detector apparatuses 30, 32 examine the pellets for optical contaminants, in particular in the area of their surface. In turn, the measurements results are fed to the evaluation apparatus integrated into the control and regulation apparatus and the evaluation apparatus decides based on the measurement results whether the examined pellets should be sorted out as defective. If the evaluation apparatus detects pellets to be sorted out as defective based on the measurement results of one of the detector apparatuses 22, 26, 30, 32, a blowout apparatus shown with reference number 34 in FIG. 1 is triggered at a suitable point in time so that the pellets to be sorted out as defective are diverted from their trajectory into the trajectory 36 indicated with B in FIG. 1 and fall into a second outlet for bad pellets.

Figure 2:
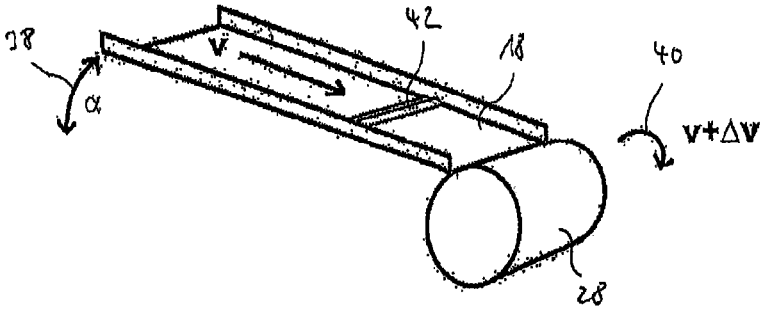

In the enlarged partial representation in FIG. 2, reference number 38 shows the tilt angle $\alpha$ of the third vibration conveyor 18 with respect to the horizontal. According to the invention, any tilt angle $\alpha$ is generally conceivable. It is mainly determined by the conveyed amount and the bulk material to be checked. Reference number 40 simultaneously shows how the conveying speed v of the pellets on the vibration conveyor 18 is manipulated by the rotation of the roller to the new conveying speed v+Av. Moreover, for illustrative purposes, reference number 42 in FIG. 2 shows, instead of the window 24, as an example a barrier progressing transversely to the conveying direction of the pellets and preferably forming in cross-section a wave profile or a triangular profile.

Figure 3:
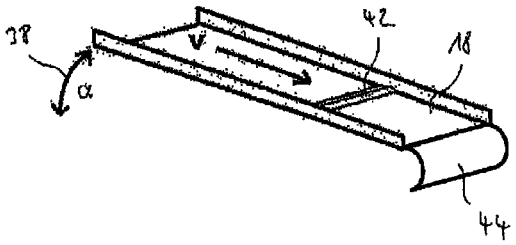
FIG. 3 is the part of the device from FIG. 1 shown in FIG. 2 according to a second exemplary embodiment in an enlarged perspective view.

FIG. 3 shows the partial representation from FIG. 2 in a second exemplary embodiment. This exemplary embodiment mainly corresponds with the exemplary embodiment according to FIGS. 1 and 2. In contrast to the exemplary embodiment according to FIGS. 1 and 2, the exemplary embodiment according to FIG. 3 provides a bent section 44 connecting to the third vibration conveyor 18 instead of the rotationally driven roller 28. The bend of the bent section 44 can be for example parabolic or circular. The bent section 44 forms a ramp supporting the trajectory of the bulk material. It is understood that the other designs explained for FIGS. 1 and 2 are also applicable for the exemplary embodiment in FIG. 3.

Figure 4:
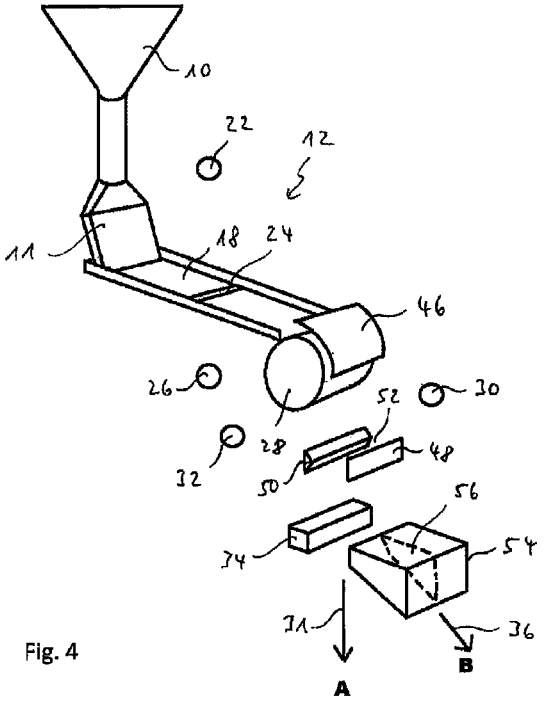
FIG. 4 is a perspective view of a device according to the invention for sorting bulk material according to a further embodiment.

The device shown in FIG. 4 mainly corresponds with the device shown in FIG. 1. In contrast to the device from FIG. 1, the device shown in FIG. 4 has only one vibration conveyor 18, on the top side of which the bulk material is fed out of the feed apparatus 10, primarily over a feed slot 11. The vibration conveyor 18 in turn has a window 24 transparent for X-ray radiation, through which the X-ray radiation source 22 shines through the bulk material located on the vibration conveyor 18, wherein the X-ray radiation is detected by the X-ray sensor 26 arranged below the window 24, as already explained above. Furthermore, in the exemplary embodiment in FIG. 4, a guide cover 46 adapted to the surface bend of the roller 28, here a bent guide plate 46, is arranged at least in sections above the rotating roller 28. A bent gap, through which the bulk material is conveyed under reduction of the variation of the trajectories, exists between the guide plate 46 and the surface of the roller 28. Moreover, a slit-like guide channel 52 delimited by a first wall 48 and a second wall 50 is formed between the roller 28 and the blowout apparatus 34 for the bulk material falling from the roller 28 to the blowout apparatus 34. The first wall 48 is level and arranged in a vertical plane. The second wall 50 has a triangular cross-section such that the guide channel 52 in the trajectory of the bulk material first narrows in cross-section and then expands again. Moreover, in the exemplary embodiment in FIG. 4, reference number 54 shows a sorting channel, which is subdivided into two channel sectors arranged next to each other through a level blade 56 arranged in a vertical plane.

Of course, it applies in turn that the designs shown in FIG. 4 can also be used for the exemplary embodiments explained based on FIGS. 1 to 3.

The invention claimed is:

1. A device for sorting bulk material comprising:

a vibration conveyor apparatus comprising a transparent window configured to allow passage of X-ray radiation;

a feed apparatus which feeds bulk material to the vibration conveyor apparatus;

a rotationally driven roller coupled to one end of the vibration conveyor apparatus and configured to impart a predetermined trajectory to the bulk material;

a first outlet configured to receive the bulk material conveyed over the end of the vibration conveyor apparatus at the predetermined trajectory;

a second outlet;

at least one detector apparatus configured to examine the bulk material conveyed by the vibration conveyor apparatus for defects, the detector apparatus comprising, at least one X-ray detector apparatus comprising at least one X-ray radiation source and at least one X-ray sensor, wherein the at least one X-ray radiation source shines through the transparent window and the bulk material conveyed over the vibration conveyor apparatus, and wherein the at least one X-ray sensor detects the X-ray radiation shining through the bulk material and the transparent window;

a first optical detection apparatus and a second optical detection apparatus, wherein the first optical detection apparatus is configured to examine the bulk material from a top side on the rotationally driven roller or after leaving the rotationally driven roller, and the second optical detection apparatus is configured to examine the bulk material from a bottom side when the bulk material is in free fall after leaving the rotationally driven roller; and a sorting apparatus configured to alter the predetermined trajectory of the bulk material identified as defective by the detector apparatus such that the bulk material may be deposited into the second outlet, wherein at least one of the first optical detection apparatus and the second optical detection apparatus is configured to operate in at least one of a visible wavelength range or an infrared wavelength range with at least one optical radiation source and at least one optical sensor.

2. The device of claim 1, wherein at least one of the at least one optical sensor and the at least one X-ray sensor comprises a high-speed sensor.

3. The device of claim 1, wherein at least one optical detector apparatus is configured to examine the bulk material in front of a non-illuminated dark background, and wherein a plane of focus of the at least one optical sensor lies in a same plane as the bulk material to be examined.

4. A device for sorting bulk material comprising:

a vibration conveyor apparatus;

a feed apparatus which feeds bulk material to the vibration conveyor apparatus;

a rotationally driven roller coupled to one end of the vibration conveyor apparatus and configured to impart a predetermined trajectory to the bulk material, wherein the rotationally driven roller is at least partially comprised of a material transparent for X-ray radiation;

a first outlet configured to receive the bulk material conveyed over the end of the vibration conveyor apparatus at the predetermined trajectory;

a second outlet;

at least one detector apparatus configured to examine the bulk material conveyed by the vibration conveyor apparatus for defects, the detector apparatus comprising, at least one X-ray detector apparatus comprising at least one X-ray radiation source and at least one X-ray sensor, wherein the at least one X-ray sensor is configured in a torque-proof manner within the rotationally driven roller or positioned below or above the rotationally driven roller, and wherein the at least one X-ray radiation source shines through the bulk material conveyed over the rotationally driven roller and the X-ray radiation shining through the bulk material is detected by the at least one X-ray sensor, a first optical detection apparatus and a second optical detection apparatus, wherein the first optical detection apparatus is configured to examine the bulk material from a top side on the rotationally driven roller or after leaving the rotationally driven roller, and the second optical detection apparatus is configured to examine the bulk material from a bottom side when the bulk material is in free fall after leaving the rotationally driven roller; and a sorting apparatus configured to alter the predetermined trajectory of the bulk material identified as defective by the detector apparatus such that the bulk material may be deposited into the second outlet, wherein at least one of the first optical detection apparatus and the second optical detection apparatus is configured to operate in at least one of a visible wavelength range or an infrared wavelength range with at least one optical radiation source and at least one optical sensor.

5. The device of claim 4, wherein at least the vibration conveyor apparatus is surrounded by a closed housing.

6. The device of claim 4, wherein the sorting apparatus comprises a blowout or suction apparatus configured to divert the bulk material identified as defective from the predetermined trajectory by blowing or suctioning such that the bulk material is deposited into the second outlet.

7. A device for sorting bulk material comprising:

a vibration conveyor apparatus comprising a window transparent for X-ray radiation is disposed in a floor of the vibration conveyor apparatus;

a feed apparatus configured to feed bulk material to the vibration conveyor apparatus;

a curved section comprising a ramp that is coupled to one end of the vibration conveyor apparatus and configured to impart a predetermined trajectory to the bulk material;

a first outlet configured to receive bulk material that is conveyed over an end of the vibration conveyor apparatus at the predetermined trajectory;

a second outlet;

at least one detector apparatus configured to examine the bulk material conveyed by the vibration conveyor apparatus for defects, the detector apparatus comprising, at least one X-ray detector apparatus comprising at least one X-ray radiation source and at least one X-ray sensor, wherein the at least one X-ray radiation source shines through the window transparent for X-ray radiation and the bulk material conveyed over the vibration conveyor apparatus, and wherein the at least one X-ray sensor detects the X-ray radiation shining through the bulk material and the window transparent for X-ray radiation, and at least one optical detector apparatus configured to operate in at least one of a visible wavelength range or in an infrared wavelength range with at least one optical radiation source and at least one optical sensor; and a sorting apparatus configured to alter the predetermined trajectory of bulk material identified as defective by the detector apparatus and conveyed over the end of the vibration conveyor apparatus such that the bulk material identified as defective falls into the second outlet.

8. The device of claim 7, wherein at least the vibration conveyor apparatus is surrounded by a closed housing.

9. The device of claim 7, wherein the detector apparatus includes a first optical detector apparatus and a second optical detector apparatus, the first optical detector apparatus is configured to examine the bulk material from a top side on the curved section, and the second optical detector apparatus is configured to examine the bulk material from a bottom side when the bulk material is in free fall after leaving the curved section.

10. The device of claim 7, wherein at least one optical detector apparatus is configured to examine the bulk material in front of a non-illuminated dark background, and wherein a plane of focus of the at least one optical sensor lies in a plane of the bulk material to be examined.

11. The device of claim 7, wherein the sorting apparatus comprises a blowout or suction apparatus configured to divert the bulk material identified as defective from the predetermined trajectory by blowing or suctioning such that the bulk material is deposited into the second outlet.

12. The device of claim 7, wherein the curved section is parabolic in shape.

13. A method for sorting bulk material comprising:

feeding bulk material to a vibration conveyor apparatus, the vibration conveyor apparatus comprising a window transparent for X-ray radiation;

conveying non-defective bulk material over one end of the vibration conveyor apparatus at a predetermined trajectory and into a first outlet;

examining the bulk material for defects using an assembly comprising, at least one X-ray detector apparatus having at least one X-ray radiation source, at least one X-ray sensor, and a first and second optical detection apparatus including at least one optical radiation source and at least one optical sensor, the at least one X-ray radiation source shines through the bulk material conveyed over the vibration conveyor apparatus and through the window transparent for X-ray radiation and the at least one X-ray sensor detects the X-ray radiation shining through the bulk material and the window transparent for X-ray radiation, wherein the bulk material is examined by the first optical detection apparatus from a position above the bulk material and by the second optical detection apparatus from a bottom side when the bulk material is in free fall from the end of the vibration conveyor apparatus; and manipulating the predetermined trajectory of the bulk material identified as defective and conveyed over the end of the vibration conveyor apparatus such that the bulk material is deposited into a second outlet.

14. The method of claim 13, wherein the predetermined trajectory is imparted by a rotationally driven roller.

15. The method of claim 13, wherein the predetermined trajectory is imparted by a curved section.

16. The method of claim 13, wherein at least one of the first and the second optical detection apparatus examines the bulk material in front of a non-illuminated dark background, and wherein a plane of focus of the at least one optical sensor lies in a plane of the bulk material to be examined.

* * * * *